US006425502B1

(12) United States Patent
Rauworth et al.

(10) Patent No.: US 6,425,502 B1
(45) Date of Patent: Jul. 30, 2002

(54) CONTAINMENT SYSTEM

(75) Inventors: Barry L. Rauworth, Young America; John M. Hennan, Eden Prairie, both of MN (US)

(73) Assignee: Entegris, Inc., Chaska, MN (US)

( * ) Notice: Subject to any disclaimer, the term of this patent is extended or adjusted under 35 U.S.C. 154(b) by 0 days.

(21) Appl. No.: 09/603,668

(22) Filed: Jun. 26, 2000

Related U.S. Application Data

(63) Continuation-in-part of application No. 09/025,821, filed on Feb. 19, 1998, now Pat. No. 6,079,597.

(51) Int. Cl.[7] ..... B65D 83/00

(52) U.S. Cl. ..... 222/400.7; 222/464.1; 137/212; 285/921

(58) Field of Search ..... 222/400.7, 464.1, 222/538, 568; 137/212; 285/921

(56) References Cited

U.S. PATENT DOCUMENTS

| | | | | |
|---|---|---|---|---|
| 3,743,145 | A | 7/1973 | Johnston | |
| 3,868,049 | A | 2/1975 | Johnston | |
| 3,891,118 | A | 6/1975 | Laurizio | |
| 4,093,124 | A | 6/1978 | Morane et al. | |
| 4,114,779 | A | 9/1978 | Stoll, III | |
| 4,231,489 | A | 11/1980 | Malone | |
| 4,625,889 | A | 12/1986 | Baughman | |
| 4,699,298 | A | 10/1987 | Grant et al. | |
| 4,972,568 | A | 11/1990 | Schurr | |
| 4,979,545 | A | 12/1990 | Fair | 141/83 |
| 5,199,613 | A | 4/1993 | Magrath et al. | |
| 5,204,499 | A | 4/1993 | Favalora | |
| 5,511,692 | A | 4/1996 | Willingham | |
| 5,526,956 | A | 6/1996 | Osgar | 222/83 |
| 5,636,769 | A | 6/1997 | Willingham | |
| 5,667,253 | A | 9/1997 | Jansen et al. | |
| 6,079,597 | A * | 6/2000 | Rauworth et al. | 222/400.7 |

FOREIGN PATENT DOCUMENTS

| | | |
|---|---|---|
| EP | 0 194 501 | 9/1986 |
| EP | 0 557 913 | 9/1993 |
| FR | 2 593 147 | 7/1987 |
| GB | 2 294 455 | 5/1996 |
| WO | WO 94 14697 | 7/1994 |
| WO | WO 95 09126 | 4/1995 |

* cited by examiner

*Primary Examiner*—Philippe Derakshani
(74) *Attorney, Agent, or Firm*—Patterson, Thuents, Skaar & Christensen

(57) ABSTRACT

In a preferred embodiment, a blow molded drum has a port including a neck with exterior buttress threads and a port opening having a shoulder. A snap-in down tube assembly seats with the shoulder and has an upwardly extending nipple. Either a dispense head or a closure seats within and is secured by a threaded retainer nut. The dispense head has a first flow duct extending to a nipple engaging portion to seal with the upwardly extending nipple and a second flow duct leading to an annular space around the nipple for a return fluid line or for providing air or a gas for displacing withdrawn fluid. In a preferred embodiment the threaded nut provides an axial tightening force and also provides an axial removal force that disengages the nipple engaging portion with the nipple as the retainer nut is loosened.

15 Claims, 7 Drawing Sheets

CONTAINMENT SYSTEM

This is a continuation-in-part of application Ser. No. 09/025,821, filed Feb. 19, 1998 and issuing Jun. 27, 2000 as U.S. Pat. No. 6,079,597. Said application and patent are hereby incorporated by reference.

BACKGROUND OF THE INVENTION

This invention relates to containment systems and more particularly containment systems particularly useful in the semiconductor processing industry comprising plastic drums with ports and fitting assemblages for connecting to/or closing said ports.

Blow molded thermoplastic drums have replaced steel drums in many applications. Particularly in the semiconductor processing industry, the chemicals to be contained are highly pure, quite aggressive and react with, and are contaminated by contact with metals. Such drums are typically blow molded of high density polyethylene. It is appropriate to eliminate any additives in the polyethylene (PE) that contacts the fluid in the drum and the fitting assemblages system since such additives may diffuse into the highly pure chemicals and contaminate same. Such drums are subject to Department of Transportation regulations which require that the exterior of the drum has ultraviolet inhibitors to prevent or minimize the degradation of the drum. The need to have additives in the PE at the exterior of the drum and the need to have highly pure PE on the interior fluid contacting surfaces has been addressed by the use of a multiple layered parison during the blow molding of the drums.

Known plastic drum containment systems for use in containing and dispensing highly pure chemicals have been structurally complex with numerous seals and therefore are relatively expensive. The expense often dictates that the system components must be used multiple times rather than allowing a single use. The complexity is due in part to the need to provide port connections and closures of very high integrity while overcoming the deficiencies in the blow molding process. These deficiencies relate primarily to the high tolerances inherent in the formation of threaded surfaces and sealing surfaces at the port during the blow molding process. Conventionally the systems will utilize interior threads on the drum neck which are formed during the blow molding process. Secondary fittings will threadingly engage with the neck and will trap and axially compress sealing rings between the secondary fitting and the top edge or at least an upwardly facing surface of the neck. The injection molded secondary fitting will then provide appropriate precision threaded surfaces and sealing surfaces for attachment of closures or dispense heads. See, for example, U.S. Pat. Nos. 5,526,956; 5,511,692; 5,667,253; 5,636,769; and 5,108,015, all of which are incorporated herein by reference. Conventionally, such connections between the secondary fitting and closure or dispense head will use axially loaded o-rings. In containment systems as such, axially loaded O-rings tend to need replacement more frequently than desired and tightening torques of the dispense heads and closures are more critical than desirable. A sealing system is needed that provides longer lasting O-rings and less critical tightening torque requirements.

Moreover, these secondary fittings typically require significant annular space in that they are in engagement with the inside threads of the neck of the drum port. This use of space restricts the space available for flow ducts. Additionally, the inside threads are difficult to clean.

Such containment systems may utilize dispense heads and down tube assembles for withdrawal by suction of the chemicals in the drums. Conventionally, such dispense heads and down tube assemblies are structurally complex, have several sealing surfaces, and thus are required to be precisely molded or machined. A containment system is needed that utilizes a simplified dispense head and down tube assembly each with a minimal number of sealing surfaces.

A simple containment system is needed that provides sealing and connection surfaces for closures and dispense heads for high purity chemicals such as used in the semiconductor processing industry. Such a system should have structurally simple components, a minimal number of o-rings, and provide connections and closures of high integrity.

Closures for such ports may or not be vented and may have valves for discharging pressure buildup in the drum. Such closures typically are formed of multiple components with exteriorly exposed openings, perforations, tool recesses, and interfaces between the components. Such openings, interfaces, recesses, and perforations may operate as collection points for impurities, contaminants, the contents of the drum, or other matter. Additionally such openings, perforations, and interfaces provide a pathway for leakage of the contents of the drum or for entry of contaminants into the interior of the drum. A closure is needed that has the minimal number of perforations, vents, and interfaces between components. Ideally, such a closure will have a smooth outer shell completely covering the neck without any exposed perforations, openings, or interfaces between components of the closure.

Moreover, a closure sealing directly with the inside threads, such as a plug, as opposed to a closure on a secondary fitting, will require tightening said plug directly and the requirement that the closure does not have UV inhibiting additives in contact with the drum contents necessitates that the exterior of the plug also be free of UV inhibitors which is not an ideal situation. A closure is needed in which the component part that is being tightened with the threads on the neck is not the component part which is sealing the neck opening and which is exposed to the contents of the drum.

Conventional dispense heads may be attached to ports by a retainer nut securing a flange on the dispense head to the port. Typically, the retainer nut will only provide a downward or tightening force. Removal of the dispense head and disconnection of any fluid couplings within the dispense head are done by a separate manual action. That is, first the retainer nut is loosened and then the dispense head is lifted upward. Where the fluid couplings within the dispense head are axially connected concentric portions, there may be some mechanical resistance associated with said manual separation. Said resistance can create a potential of a sudden unexpected release and separation that can cause the splashing of residual fluid from the concentric portions. Particularly in industries such as the semiconductor processing industry, the fluids involved can be highly caustic presenting a significant personal injury issue. It would be desirable to have a system which provides a controlled safe release of the fluid couplings within a dispense head during disconnection of the dispense head.

SUMMARY OF THE INVENTION

In a preferred embodiment, a blow molded drum has a port including a neck with exterior buttress threads and a port opening having a shoulder. A snap-in down tube assembly seats with the shoulder and has an upwardly extending nipple. Either a dispense head or a closure seats within and is secured by a threaded retainer nut. The dispense head has a first flow duct extending to a nipple engaging portion to seal with the upwardly extending nipple and a second flow duct leading to an annular space around the nipple for a return fluid line or for providing air or a gas for displacing withdrawn fluid. In a preferred embodiment the threaded nut provides an axial tightening force and also provides an axial removal force that disengages the nipple engaging portion with the nipple as the retainer nut is loosened.

In other preferred embodiments, the closure is preferably comprised of a cylindrically shaped interior liner portion for engaging and sealing with the cylindrical sealing surface of the sleeve, such as by an o-ring, and has a pathway which includes the spiral gap between the cooperating buttress threads on the neck and on the retainer. A microporous membrane may be placed in the pathway to allow venting of gases but preclude leakage of the liquid in the drum.

An advantage and feature of the invention is that the down tube assembly simply drops in and snaps in place.

An advantage and feature of the invention is that the down tube assembly utilizing the nipple provides a simple connection providing a reliable seal of high integrity.

An advantage and feature of the invention is that the simplified down tube assembly is easily assembled, is relatively inexpensively manufactured and thus facilitates one-time use of the drum and down tube assembly.

An advantage and feature of the invention is that with the closure in place as described on a multiple layer drum, all outwardly exposed polyethylene of the closure may have UV light inhibitors while all of the polyethylene exposed to the contents of the drum will not. Moreover, the sealing is accomplished with the two component parts of the closure only loosely coupled together. That is, the torque is not transferred from the shell to a separate component which is engaging the threads on the neck. Additionally, the criticality of the tightening of the shell portion is minimized in that the radial seal of the cap liner is not dependant thereon.

A further advantage and feature of the invention is that the retainer nut provides a controlled disconnection of the fluid connecting portions between the dispense head and the down tube assembly. The controlled disconnect provides a high level of safety during the disconnect.

DETAILED DESCRIPTION OF PREFERRED EMBODIMENTS

Figure 1:
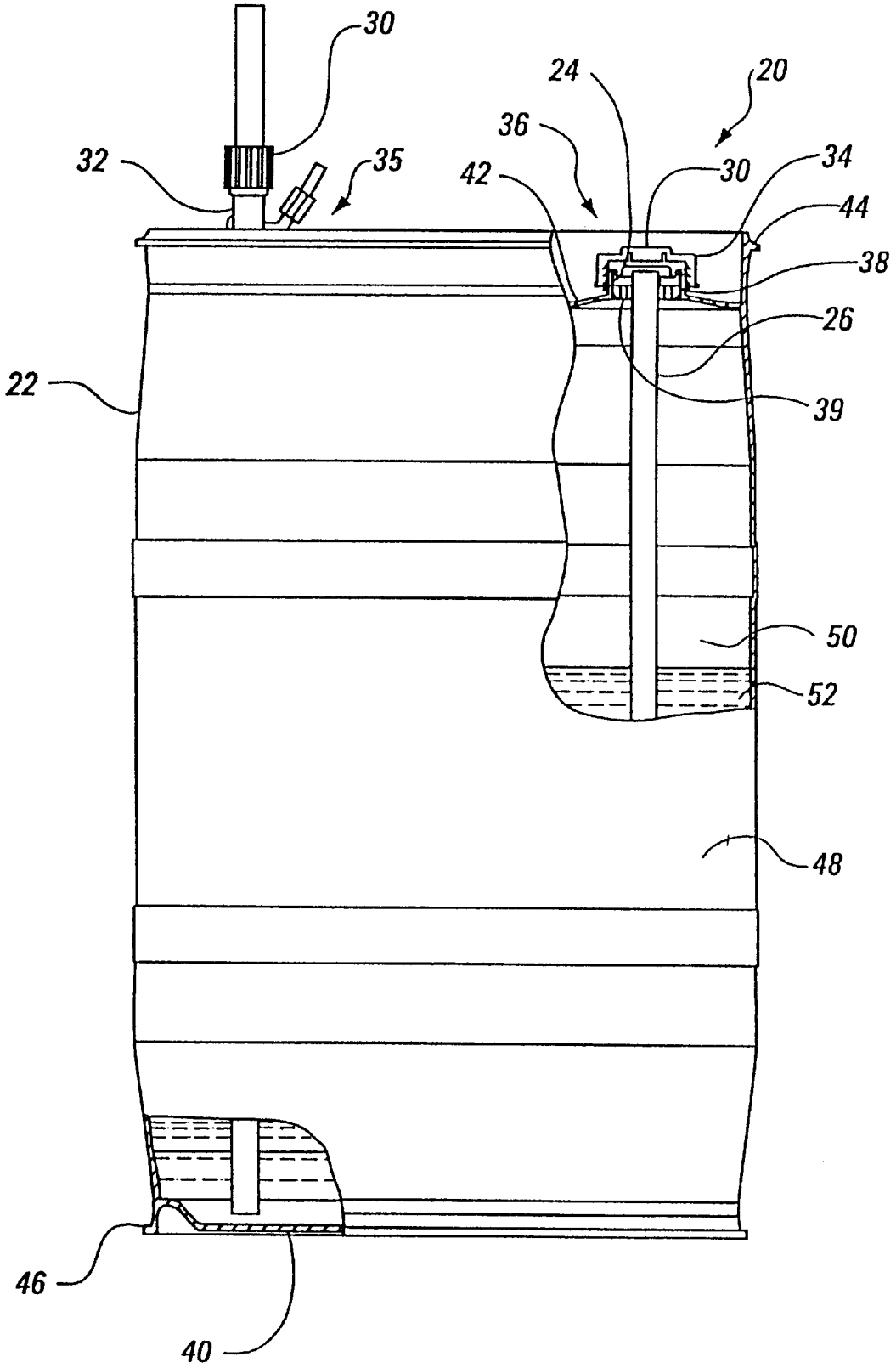
FIG. 1 is an elevational view of the containment system with portions of a drum and closure cut-away to reveal particular details.

Referring to FIG. 1 a containment system according to the invention is shown and is generally indicated by the numeral 20. The principal components of the invention are a blow molded drum 22 with a fusion bonded sleeve 24, a down tube assembly 26, and a port fitting assemblage 30 which may either be a dispense head 32 or a closure 34. The drum includes a pair of ports 35, 36 each of which have a neck 38 and a port opening 39.

The blow molded drum is similar to those known in the art in the sense that it has a substantially flat bottom 40, a substantially flat top 42, an upper chime 44, and a lower chime 46. A side wall 48 which is substantially cylindrical and an open interior 50 for holding typically ultrapure chemical contents 52.

Figure 2:
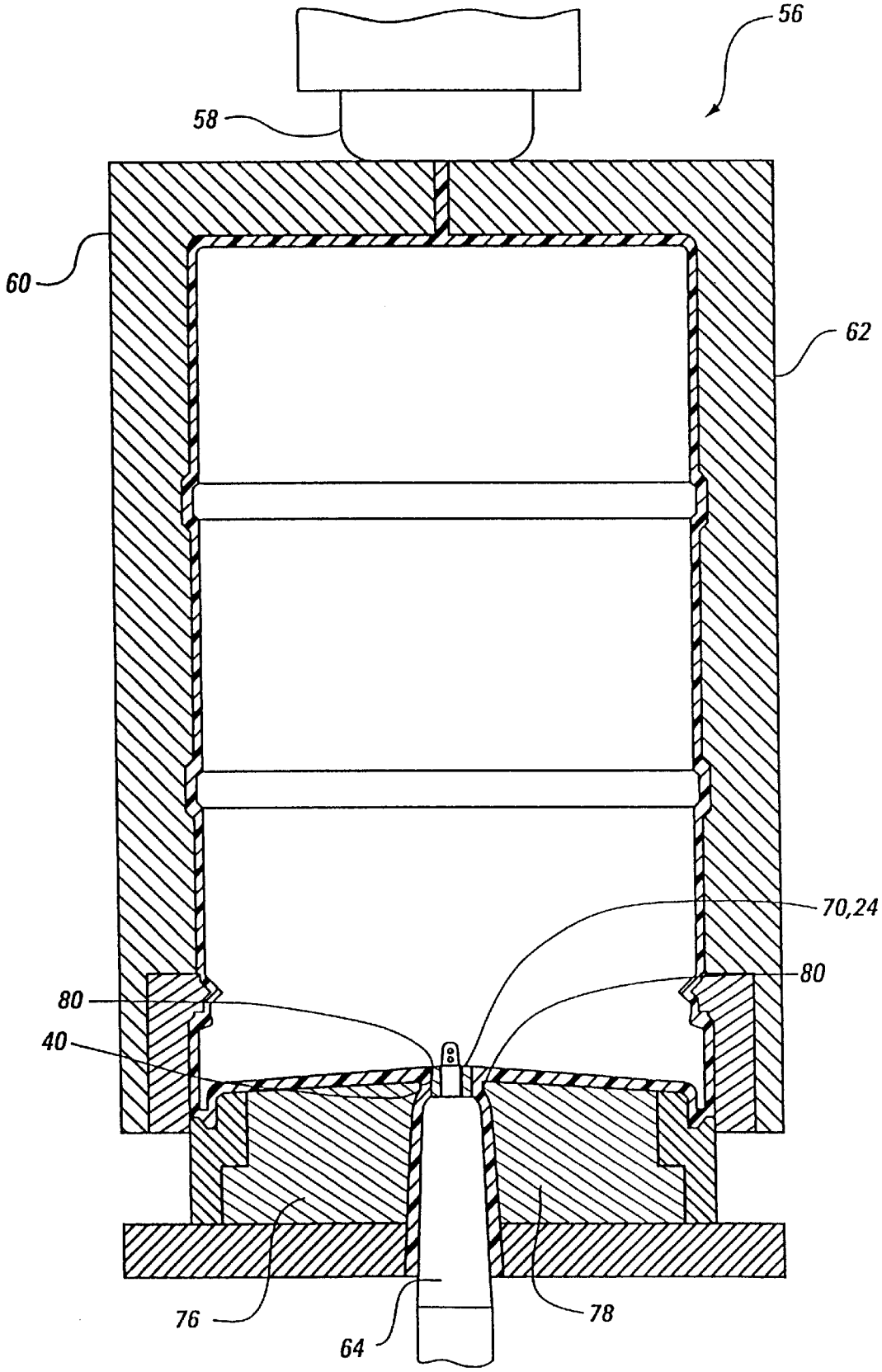
FIG. 2 is a cross-sectional elevational view of a blow mold apparatus for making drums in accordance with the invention herein.

Referring to FIG. 2 a cross-section of a blow mold apparatus generally of the type suitable for forming such blow molded drums is illustrated. The blow mold apparatus 56 has a parison extrusion portion 58, a pair of mold halves 60, 62 and a blow pin 64. The blow pin 64 in the preferred embodiment has a injection molded sleeve 70 inserted thereon prior to the commencement of the blow molding process. When the mold portions come together, the parison is squeezed against said injection molded sleeve portion and is fusion bonded thereto. The mold portions 76, 78 will have thread forming surfaces 80 thereon to form preferably exterior buttress threads on the neck 38 of the blow molded drum. The sleeve may have suitable structure to facilitate a secure mechanical connection.

Figure 4:
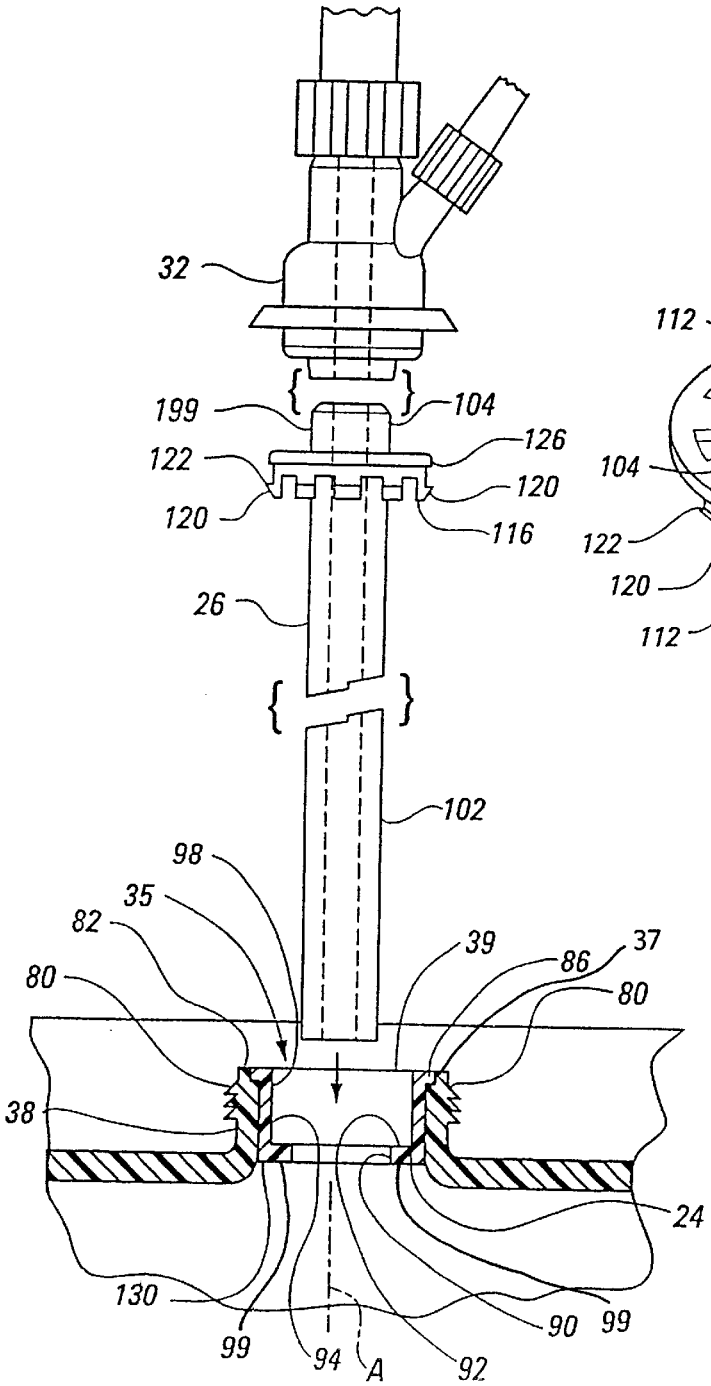
FIG. 4 is a exploded view of a down tube assembly, a dispense head, and a port of a drum.
Figure 6:
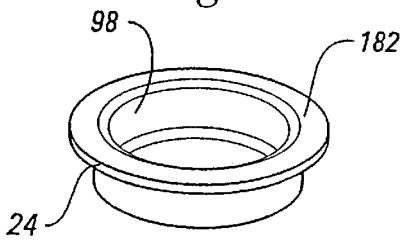
FIG. 6 is a perspective view of a sleeve in accordance with the invention.

Referring to FIGS, 3, 4, 5 and 6, details of a port 35, a port fitting assemblage 30 and the down tube assembly 26 are shown. FIG. 4 is an exploded view of the down hole assembly 26, the port 35, and the dispense head 32. The port 35 includes a neck portion 37 comprised of a neck 38 and the sleeve 24. The neck 37 has exterior buttress threads 80, a top edge 82, as well as the port opening 39. Within the neck 38 is the sleeve 24 which is shown in perspective view in FIG. 6. The sleeve has an upper lip 86, a first engagement structure 90 configured as a shoulder with a seating surface 92. The sleeve has a inner periphery 94 which is substantially cylindrical and includes an O-ring sealing surface 98 and downwardly facing finger engagement portions 99. Note that the port 32 has an axis A and the neck and cylindrical periphery 94 are coaxial and concentric.

Figure 3A:
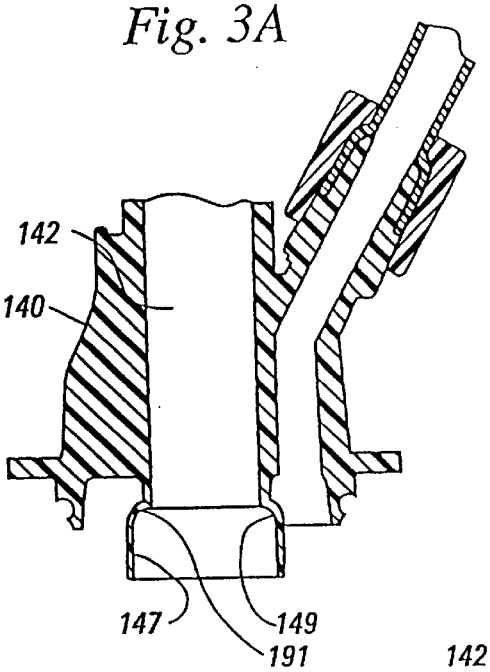
FIG. 3A is a cross-sectional view of a dispense head with an alternate nipple engaging portion.
Figure 3:
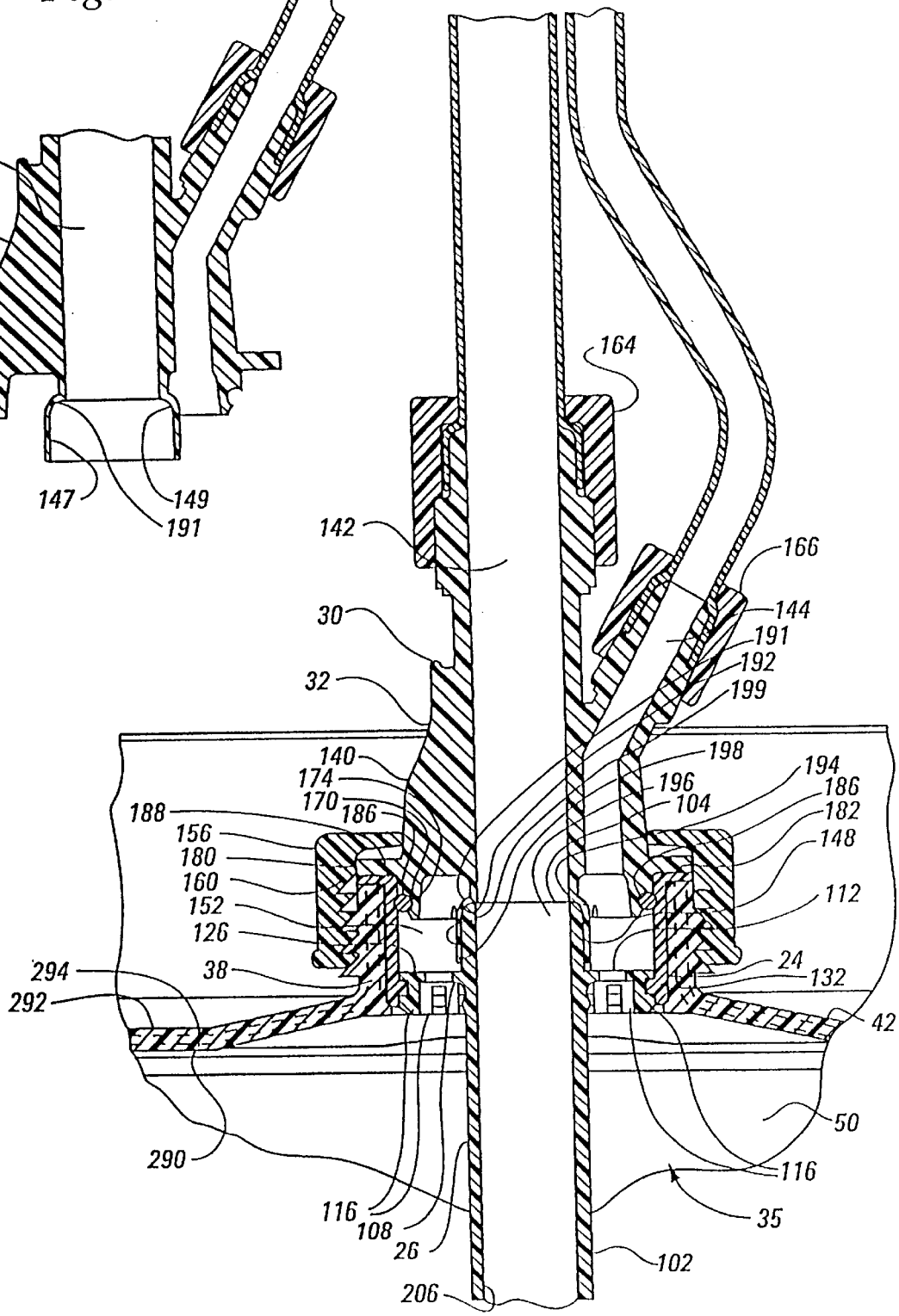
FIG. 3 is a cross-sectional elevational view of a dispense head and port of a plastic drum.
Figure 5:
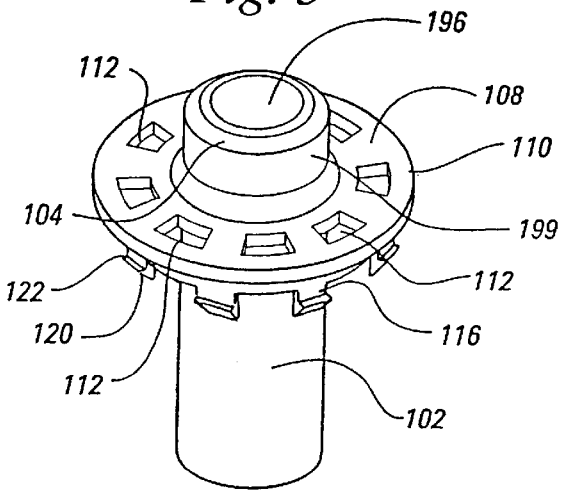
FIG. 5 is a perspective view of a down tube assembly.

Continuing to refer to FIGS. 3, 4, and 5, the down tube assembly 26 is comprised of a down tube 102, an upwardly extending fluid connection portion configured as a nipple 104, and an annular support member 108. The annular support member 108 has a periphery 110 and a plurality of annular passages 112. At the periphery 110 is second engagement structures 116 configured as downwardly extending fingers with inclined wedge portions 120 and engagement surfaces 122. The annular support member also has a stop member 126 configured as a flange.

Referring specifically to FIG. 3, the down tube assembly 26 drops down into the port opening 39 "snaps" onto, seats on, and engages the sleeve 24 at the shoulder 90. The engagement surfaces 122 of the fingers 116 lock on the lower surface 130 of the shoulder. The flange 126 of the annular support member seats on the top of the shoulder. Four second engagement structures 116 are shown in FIG. 3, two of them in cross-section.

In the preferred embodiment, the sleeve 24 is fusion bonded at the interface 132 between the neck 38 and the sleeve. Alternate means of sealing engaging may be suitable in particular applications such as welding, adhesives, threaded engagement.

Continuing to refer to FIG. 3, the dispense head 32 is comprised of a body 140 with a central first flow duct 142 and a second flow duct 144. The dispense head 32 has a downwardly extending fluid connection portion configured as a nipple engaging portion 148 shaped as a piece of flared tubing sized to fit and sealing engage with the nipple 104. FIG. 3A shows an embodiment of the nipple engaging portion 148 configured as a bore 147 with a converging section 149. Extending around the nipple 104 and the nipple engaging portion 148 is an annular space 152. Said annular space is in flow communication with the second flow duct 144. The annular passages 112 also connect to said annular space 152 and thus connect the second flow duct 144 to the interior 50 of the drum adjacent the top 42. The dispense head also has a retainer 156 configured as a nut and has interior buttress threads 160 shaped and sized to cooperate with the exterior buttress threads on the neck 38. The dispense head has two connector portions 164, 166 for connecting the first flow duct and the second flow duct respectively to tubing. The connector portions as shown are configured as the flared tubing connectors available from Fluoroware, Inc., the assignee of the invention, and sold under the trademark FlareTek®.

The body 140 may suitably be injection molded of chemically inert plastic such as fluoropolymers, for example perfluoroalkoxy (PFA) . The body has a cylindrical portion 170 with a circular periphery 174 which in the embodiment shown comprises an O-ring groove. The body also has a flanged portion 180 extending radially outward which engages with the retainer 156 and is clamped between said retainer and the top surface 182 of the sleeve. The primary seal between the dispense head and the port is at the O-ring 186 which in this embodiment provides essentially a pure radially seal. In other words, the axial force provided by the dispense head being clamped to the port by the retainer 156 does not affect the compression of the O-ring 186 or the integrity of the seal provided thereby. The o-ring may suitably be formed of silicon encased in fluorethylene propylene (FEP). Secondary sealing may be provided by the interface 188 between the flange 180 and the top surface 182 of the sleeve.

The nipple engaging portion 148 is appropriately sized such that the clamping provided by the retainer positions the shoulder 191 and its annular engaging surface 192 against the upper peripheral surface surrounding the opening 196 of the nipple 104. The nipple engaging portion 148 thus seals at the upper peripheral surface and also is suitably sized such that there is also a radial seal between the cylindrical portion 198 of said flared tube and the outer cylindrical surface 199 of the nipple. The first flow duct is sized consistent with the bore 206 through the down tube assembly.

The down tube assembly may be suitably formed from separate injection molded or machined plastic components, ideally fromchemically inert plastic such as PFA, which are welded or otherwise suitably joined.

Referring to FIGS. 7, 8, 9, 10, and 11, views of a port fitting assembly 30 configured as a closure 34 and components thereof are depicted. The closure is comprised of a body 212 configured as a cap liner 220 rotatably engaged within a retainer configured as shell portion 222 which has internal buttress threads 226 at a substantially cylindrical side wall 230 which is integral with a top portion 232 which has a periphery 234. The cap liner 220 has a downwardly extending cylindrical portion 240 with a circular periphery 242 configured as an O-ring groove supporting the O-ring 244. Said O-ring radially seals against the inner cylindrical periphery 94 of the sleeve 24. The liner may be solid, without perforations, or alternatively may have a microporous membrane 250 affixed in a recess 252 with perforations 260 extending through the cap liner into the interior space 264 between the shell portion and the cap liner defining a pathway 270. The pathway further extends to and is comprised of the spiral gap 266 between the interior buttress threads 226 and the exterior buttress threads 80 of the neck 38. The buttress threads are configured to have said gap 266 constituting the pathway 270 whether the closure is tightly or loosely secured to the neck 38.

Figure 7:
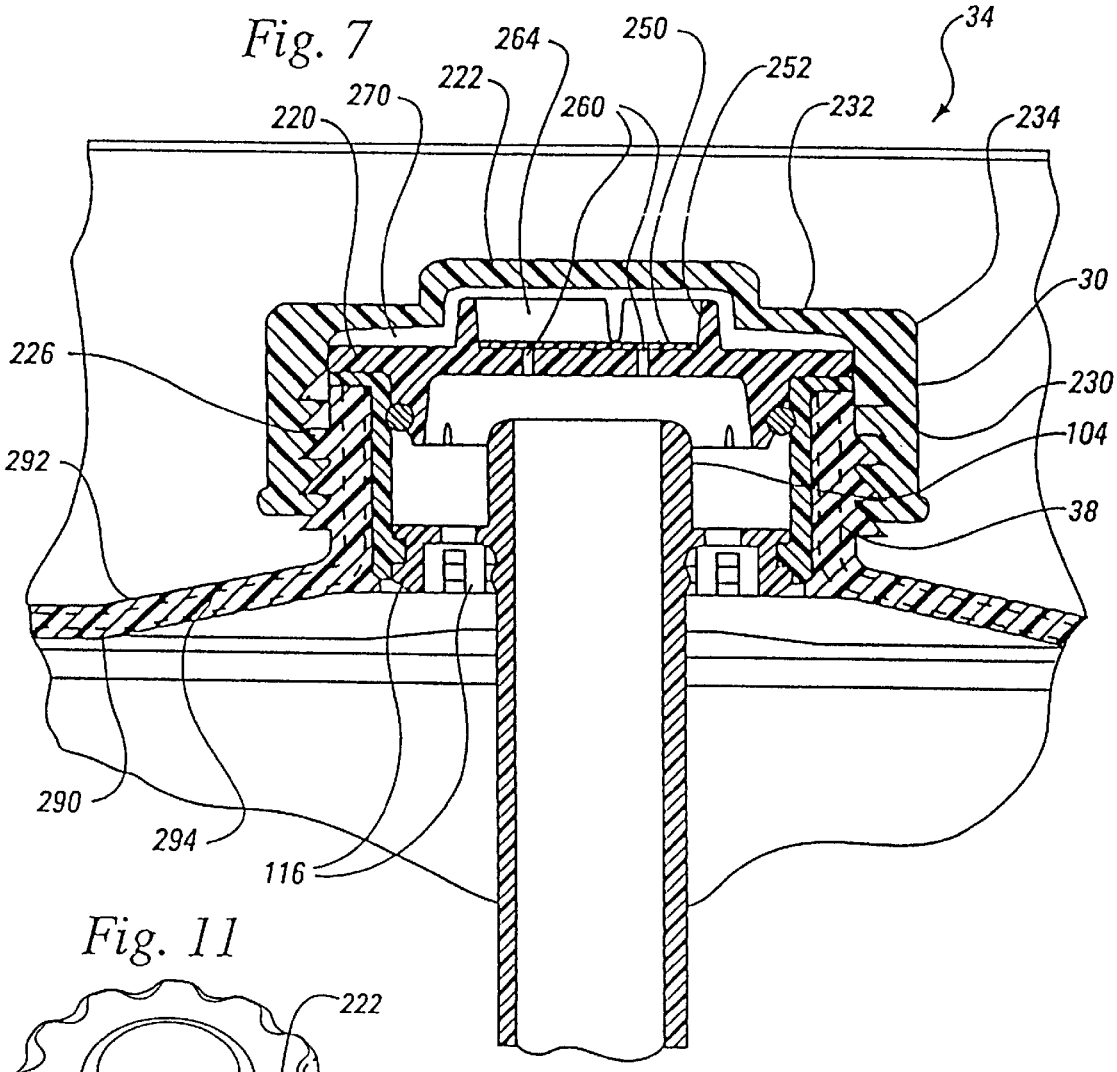
FIG. 7 is a cross-sectional view of a closure in place on a port in accordance with the invention.
Figure 11:
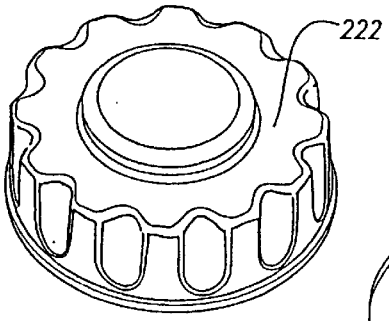
FIG. 11 is a perspective view of a shell portion of a closure.
Figure 10:
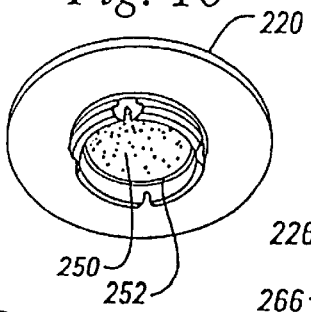
FIG. 10 is a top view of the cap liner of FIG. 9.

The shell portion 222 of the closure in the preferred embodiment will have ultraviolet light inhibitor additives. The cap liner 220 is preferably formed of an ultrapure polyethylene without having additives such as ultraviolet light inhibitors. The cap liner may be formed of the same highly pure polyethylene that is on the interior contact surface 290 of the drum. Referring to FIG. 7, three layers of the wall are portrayed by way of the dashed lines. The inner layer 290 will be of ultrapure polyethylene. The exterior layer 292 will typically be formed of a polyethylene with the ultraviolet light inhibitors. The inner layer 294 can be comprised of recycled scrap polyethylene originating from the molding process or from recycled drums. Thus with a multiple layer drum and the closure of FIG. 7, no polyethylene with UV light inhibitors is exposed to the contents of the drum and no ultrapure polyethylene is exteriorly exposed when the closure is in place.

Figure 8:
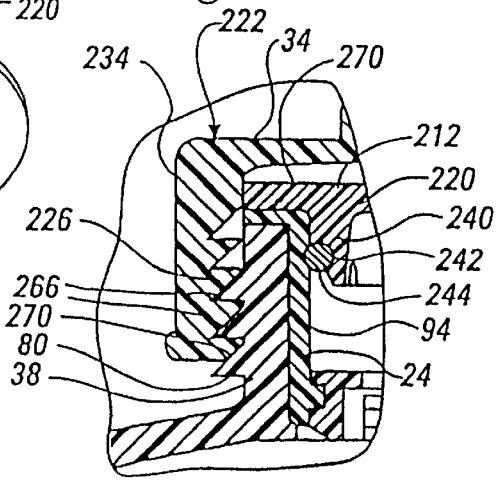
FIG. 8 is a detailed cross-sectional view of a portion of a closure engaged with a port of drum in accordance with the invention.
Figure 9:
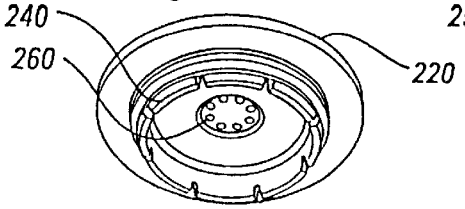
FIG. 9 is a bottom view of a cap liner in accordance with the invention.

Referring to FIG. 8, and particularly the o-ring 242, a significant aspect of the invention is depicted. The o-ring sealing surface 98 is on the upright, substantially vertical, non grooved cylindrical side wall 298. Thus, a seal is provided with minimal or no axial loading on the o-ring, a substantially pure radially loaded seal which facilitates longer seal life and less critical tightening of the retainer 222.

Figure 12:
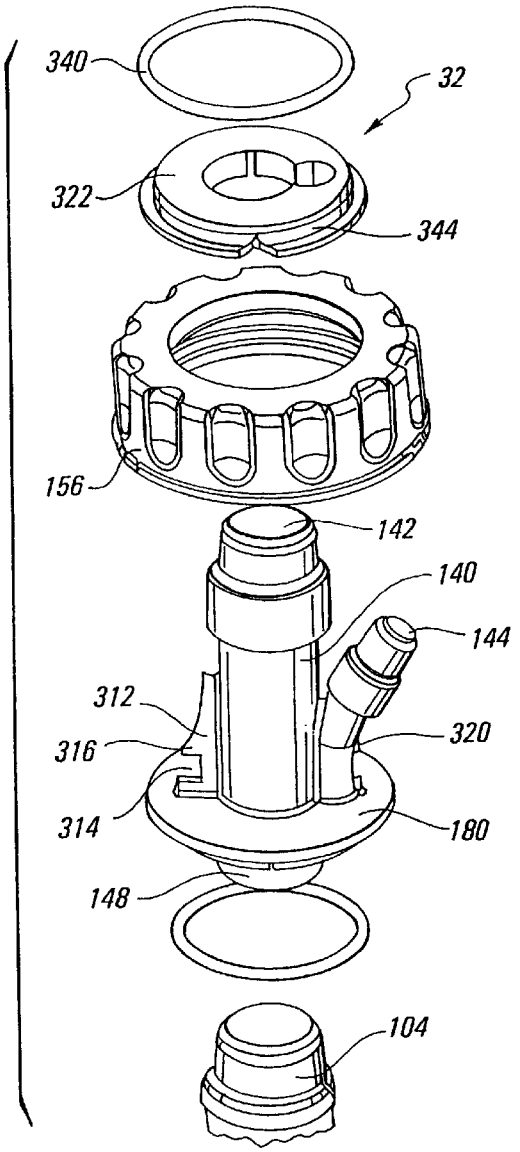
FIG. 12 is an exploded perspective view of a dispense head having the feature of the controlled disconnect.
Figure 13:
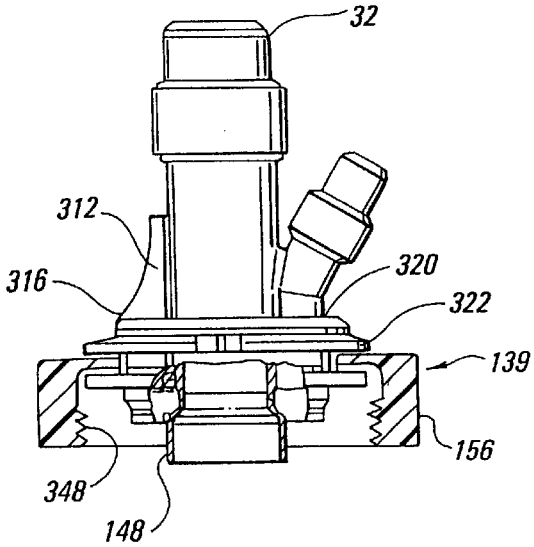
FIG. 13 is an elevational and partial sectional view of the body of the dispense head of FIG. 12.
Figure 14:
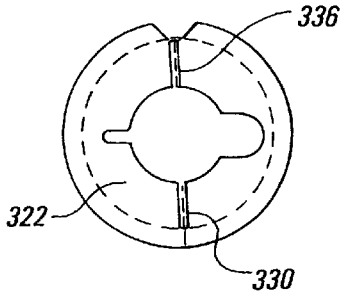
FIG. 14 is a plan view of the thrust member.

Referring to FIGS. 12, 13, and 14, details of the controlled disconnect feature of a particular embodiment of the invention are illustrated. The dispense head body 140 has a flanged portion 180 which the retainer nut 156 compresses against the neck of the port. In this embodiment, a gusset 312 with a cutaway portion 314 provides an engagement portion 316 upon which a thrust member 322 acts when the retainer nut 156 is unscrewed for removal of the dispense head and disconnection of the fluid connecting portions, such as the nipple and nipple engaging portion. Similarly a second engagement portion 320 positioned opposite the first engagement portion 316 provides a thrust-receiving portion. The thrust member 322 is made from a resilient and rigid plastic that has a slit 330 that allows the thrust member to be opened to be applied to and positioned above the retainer nut and below the first and second engagement portions 316, 320. The thrust member further has a thinned portion 336 that further facilitates said placement and removal on the dispense head body 140. A resilient O-ring 340 fits in a circumferential groove 344 to retain the thrust member properly positioned on the dispense head body 140. The aperture 344 in the thrust member is appropriately shaped to follow the exterior shape of the dispense head body. This is particularly appropriate where the wall thickness of the dispense head body is kept to a minimum.

With the retainer nut and dispense head secured on the neck of a port, unscrewing the retainer nut pushes upward on the thrust member and also on the engagement portions 316, 320 of the dispense head body. This causes the nipple engaging portion to axially slide on the nipple to disconnect from same. The threaded portions 348 of the retainer nut and the length of the nipple engaging portions are suitably sized to allow separation of the nipple and nipple engaging portions before the retainer nut is totally unscrewed from the neck of the port.

Figure 15:
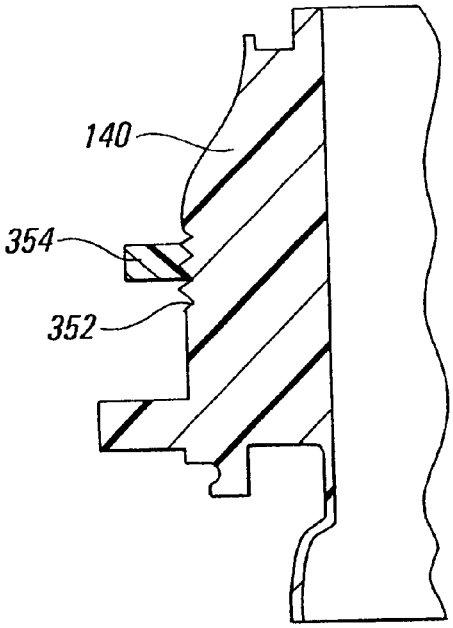
FIG. 15 is a sectional view of the body of a dispense head in accordance with the invention herein.
Figure 16:
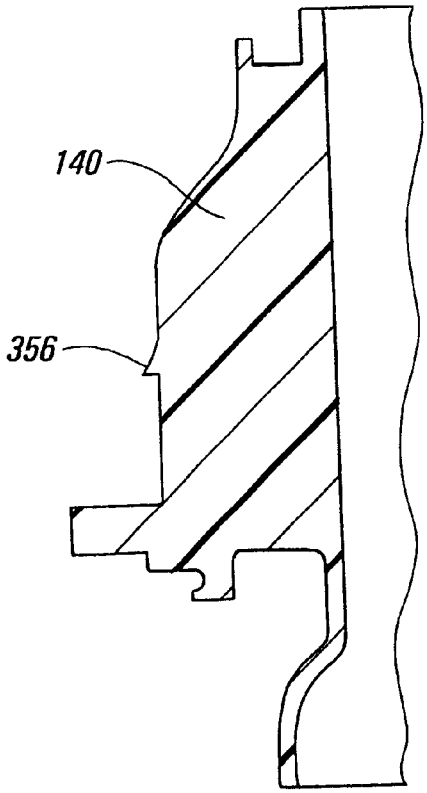
FIG. 16 is a sectional view of the body of a dispense head in accordance with the invention herein
Figure 17:
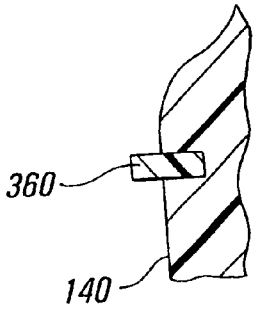
FIG. 17 is a sectional view of the body of a dispense head in accordance with the invention herein.

Referring to FIGS. 15, 16, and 17, alternate engagement members are illustrated that can provide engagement with the retainer nut or an intermediate thrust member to provide the upward disconnect force on the dispense head body for disconnecting the fluid connecting portions. These embodiments all use the lifting mechanism 139 of the threaded retainer nut and threaded neck. FIG. 15 illustrates additional threads 352 on the dispense head body 140 and a threaded engagement member 354 that provides an adjustment feature to the positioning of the engagement member. FIG. 16 illustrates an integral wedge shaped engagement member that the retainer nut can slide over in the downward direction and effectively prevents sliding upward capturing the retainer nut. FIG. 17 illustrates a plastic pin 360 press fit into the dispense head body.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A drum containment system for dispensing aggressive chemicals in liquid form, the system comprising:

a plastic drum for containing the aggressive liquid chemicals, the drum having a bottom and a top with a port, the port having a neck portion with threads extending upwardly therefrom and defining a port opening, the neck portion having at downwardly facing finger engagement portions, a down tube assembly formed of plastic comprising an annular support member having a plurality of resilient fingers each with an angled guide-in surface and an upwardly facing lock-in surface the annular support member sized for insertion into the port opening, the down tube assembly further comprising an upwardly extending fluid connection portion and a down tube extending downwardly from the annular support member to a position proximate the bottom of the drum, whereby the down tube assembly can be lowered into and snapped into position with the resilient fingers in locking engagement with the downwardly facing finger engagement portions.

2. The drum containment system of claim 1, further comprising a dispense head for removably connecting to the port, the dispense head having a fluoropolymer body, a downward extending cooperating fluid connection portion for sliding and sealing engagement and disengagement around the upwardly extending fluid connection portion of the down tube assembly, and a retainer nut, the retainer nut adapted to threadingly engage the neck and to tighten and loosen thereon and to provide an upward force on the dispense head body when loosened and to disengage the threads on the neck portion allowing removal of the dispense head from the port.

3. The drum containment system of claim 1 wherein the annular support member has a plurality of annular passages.

4. The drum containment system of claim 2 with the dispense head configured such that when the dispense head is engaged with the port with the retainer nut tightened on the threads of the neck and the downwardly extending cooperating fluid connection portion is engaged with the upwardly extending fluid connection portion of the down-tube assembly, the retainer nut may be loosened to force the dispense head upwardly thereby disengaging the downwardly extending fluid connection portion with the upwardly extending fluid connection portion before the retainer nut becomes disengaged with the threads on the neck portion.

5. The drum containment system of claim 4 further comprising an intermediate thrust member for transmitting the upward force to the dispense head body when the retainer nut is loosened.

6. A drum containment system for dispensing aggressive chemicals in liquid form, the system comprising:

a plastic drum for containing the aggressive liquid chemicals, the drum having a top with port, the port having a neck portion extending upwardly therefrom and defining a port opening;

a down tube assembly comprising an annular support member fixed within the port opening, the down tube assembly further having an upwardly extending fluid connection portion and a down tube extending downwardly from the annular support member;

a dispense head, the dispense head having a fluoropolymer body, a downward extending cooperating fluid connection portion sized and positioned to connect with the upwardly extending fluid connection portion, and a retainer nut, the retainer nut adapted to threadingly engage and disengage the neck and to tighten and loosen thereon and to provide an upward force when loosened, the dispense head body having a force receiving portion operatively coupled to the retainer nut whereby when the retainer nut is loosened on the threaded neck portion the dispense head body is raised from the neck portion and the downwardly extending fluid connection potion is urged to separate with the upwardly extending fluid connection portion before the retainer nut disengages with the neck.

7. A containment system comprising:

a plastic drum having atop with a port, the port having an upwardly extending neck portion and a port opening;

a plastic tube assembly configured to drop into the port opening and snaps to said port to fix the position of the down tube assembly in said port, the down tube assembly having an upwardly extending fluid connection portion configured as a nipple; and a dispense head configured to engage and seal with the port and having a downwardly extending fluid connection portion sized and positioned to slidingly and sealingly engage with the upwardly extending fluid connection portion.

8. The containment system of claim 7 wherein the dispense head seals with the port by an O-ring with substantially no axial loading.

9. The containment system of claim 7 further comprising a retainer nut for tightening and loosening the dispense head with the drum, and wherein the dispense head has a force receiving portion whereby when the retainer nut is loosened the retainer nut urges the force receiving portion to raise the dispense head.

10. A containment system comprising a dispense head and a drum with a port opening, and a down tube assembly in the port opening, the dispense head connectable and disconnectable to the drum a the port opening whereby the dispense head sealingly couples and decouples with the downtube assembly, the system further having a lifting mechanism for raising the dispense head as the dispense head is disconnected from the drum, whereby when the lifting mechanism is operated, the dispense head is raised and the dispense head decouples from the downtube assembly before the dispense head disconnects from the drum.

11. The containment system of claim 10 wherein the downtube assembly comprises an upwardly extending nipple and the dispense head slidingly and sealingly couples and decouples around the upwardly extending nipple.

12. The containment system of claim 11 wherein the downtube assembly comprises an annular support member that centrally positions the nipple in the port opening, the annular support member having an annular passage.

13. The containment system of claim 7 wherein downtube assembly has an annular support member with a plurality of passages and the annular support member centrally positions the nipple in the port opening.

14. The containment system of claim 7 wherein downtube assembly has an annular support member with a plurality of passages and the annular support member centrally positions the nipple in the port opening.

15. A containment system comprising a dispense head and a plastic drum with a port opening, and a down tube assembly positioned in the port opening, the dispense head comprising a nut that threadingly engages the drum and may be tightened and loosened with respect to the drum, the dispense head connectable and disconnectable to the drum at the port opening utilizing the nut, the dispense head sealingly couples and decouples with the downtube assembly, the nut providing force to a force receiving portion on the dispense head as the nut is loosened from the drum for decoupling the dispense head from the downtube before the dispense head disconnects from the drum.

* * * * *